US007525242B2

(12) United States Patent
Lung et al.

(10) Patent No.: US 7,525,242 B2
(45) Date of Patent: Apr. 28, 2009

(54) LAMP CLAMPING AND ELECTRICALLY CONNECTING DEVICE

(75) Inventors: Sheng-Chieh Lung, Hsinchu (TW); Chien-Wei Chang, Taichung County (TW); Hung-Ming Yang, Yunlin County (TW)

(73) Assignee: AU Optronics Corp., Hsin-Chu (TW)

( * ) Notice: Subject to any disclaimer, the term of this patent is extended or adjusted under 35 U.S.C. 154(b) by 550 days.

(21) Appl. No.: 11/194,680

(22) Filed: Aug. 2, 2005

(65) Prior Publication Data

US 2006/0202622 A1 Sep. 14, 2006

(30) Foreign Application Priority Data

Mar. 11, 2005 (TW) ..... 94107573 A

(51) Int. Cl.
*H01J 17/18* (2006.01)

(52) U.S. Cl. ..... 313/318.01; 439/226; 439/239

(58) Field of Classification Search ..... 313/318.01–318.09; 439/226, 239, 612, 619
See application file for complete search history.

(56) References Cited

U.S. PATENT DOCUMENTS 4,906,891 A * 3/1990 Takagi et al. ..... 313/318.02

FOREIGN PATENT DOCUMENTS

| | | |
|---|---|---|
| CN | 1482503 | 3/2004 |
| CN | 1588200 | 3/2005 |

* cited by examiner

*Primary Examiner*—Vip Patel
(74) *Attorney, Agent, or Firm*—Bacon & Thomas, PLLC

(57) ABSTRACT

A lamp clamping and electrically connecting device includes a base, two flexible portions and two protrusions. The flexible portions are interspaced to be disposed on the base. The protrusions are correspondingly disposed on the inner sides of the flexible portions. In a natural state, the gap between the protrusions is smaller than the diameter of an electrode end of a lamp. When the electrode end is moved towards the base in the gap between the protrusions, the electrode end presses the protrusions so that the flexible portions swing outwardly. When the electrode end touches the base, the protrusions are restored to the natural state, so that the protrusions and the base clamp the electrode end, and that the electrode end is electrically connected to the device.

26 Claims, 9 Drawing Sheets

LAMP CLAMPING AND ELECTRICALLY CONNECTING DEVICE

This application claims the benefit of Taiwan application Ser. No. 94107573, filed Mar. 11, 2005, the subject matter of which is incorporated herein by reference.

BACKGROUND OF THE INVENTION

1. Field of the Invention

The invention relates in general to a lamp clamping and electrically connecting device, and more particularly to a lamp clamping and electrically connecting device. The method is capable of promptly replacing the lamp without going through the soldering and the de-soldering steps.

2. Description of the Related Art

Due to the features of slim size, low weight, low power consumption and free of radiation pollution, liquid crystal display (LCD) has been widely used in electronic products such as personal digital assistant (PDA), notebook computer, digital cameral, digital video recorder, computer monitor and liquid crystal TV. Further die to the immense input of research and development and the adoption of large-scaled production equipment, the quality of liquid crystal display keeps improving while the prices keep sliding. As a result, the application of LCD expands widely. Since the LCD panel of LCD is not self-luminous, a backlight module is required to provide necessary light for the LCD to display the image.

A conventional LCD at least includes an LCD panel and a backlight module. A conventional backlight module includes a case, a reflective sheet, at least a lamp, a diffuser plate and an optical thin film. The optical thin film set includes a prism and a diffuser sheet for instance. The reflective sheet is horizontally pasted onto the case. The lamp is disposed on the reflective sheet. The diffuser plate is disposed on the lamp. The optical thin film set is disposed on the diffuser plate. The LCD panel is disposed on the optical thin film. Besides, the electrode end of the lamp is soldered and electrically connected to one end of the conducting wire through a soldering step, while another end of the conducting wire is electrically connected to a lamp inverter. The lamp inverter receives a power source to drive the lamp to emit the light. Besides, the light emitted by the lamp is directly projected onto the LCD panel through the functions of the reflective sheet, the diffuser plate and the optical thin film.

However, when the lamp is broken and needs to be replaced, since the electrode end of the lamp is soldered together with the conducting wire, firstly, a de-soldering step is performed to separate the old lamp from the conducting wire. Next, the new lamp is placed on the case, and the new lamp is connected to the conducting wire through the soldering and fixing step. By doing so, the entire procedure of assembling and disassembling the lamp becomes very complicated and time consuming. In terms of large-scaled liquid crystal TV, one liquid crystal TV normally has dozens of lamps. If the above-disclosed conventional procedure of assembling and disassembling the lamp is used to replace a large number of new lamps and old lamps, the entire procedure of assembling and disassembling the lamp becomes even more complicated, and more labor hours would be required for assembling and disassembling the entire lamp, which is very uneconomical.

SUMMARY OF THE INVENTION

It is therefore the object of the invention to provide a lamp clamping and electrically connecting device. According to the invention, the design and procedures of vertically and downwardly embedding the lamp into and upwardly removing the lamp from the lamp clamping and electrically connecting device enables the lamp to be electrically connected to the lamp clamping and electrically connecting device when the lamp is embedded into the lamp clamping and electrically connecting device, transcending the restrain imposed in conventional design that the lamp is soldered onto the case together with the conducting wire. Consequently, the lamp can be replaced within a short period of time, dispensing the de-soldering and the soldering steps, which are very time-consuming. So, the invention not only greatly simplifies the procedure of assembling and disassembling the lamp, but also reduces the hours required for assembling and disassembling the lamp, which is indeed very economical.

According to the object of the invention, a lamp clamping and electrically connecting device for fixing a lamp and being electrically connected to an electrode end of the lamp is provided. The lamp fixing and electrically connecting includes a base, a first flexible portion, a second flexible portion, a first protrusion and a second protrusion. The first and the second flexible portions are bendably disposed on the base and are interspaced to define an aperture. The first and the second protrusions are respectively disposed on the inner sides of the first and the second flexible portions, and are positioned above the base. When the first and the second flexible portions are in a natural state, the gap between the first and the second protrusions is smaller than the diameter of the electrode end. When the electrode end is moved towards the base in the gap between the first and the second protrusions from the aperture, the electrode end presses the first and the second protrusions so that the first and the second flexible portions swing outwardly, enabling the lamp clamping and electrically connecting device to receive the electrode end. When the electrode end passes through the first and the second protrusions and touches the base, both of the first and the second flexible portions are restored to the natural state, so that the first protrusion, the second protrusion and the base clamp the electrode end from atop and underneath, and that the electrode end is electrically connected to the lamp clamping and electrically connecting device.

According to another object of the invention, a backlight module including a case, a lamp and a lamp clamping and electrically connecting device is provided. The lamp is disposed on the case, and has a first electrode end and a second electrode end. The lamp clamping and electrically connecting device is disposed on the case for fixing the lamp and being electrically connected to the first and the second electrode ends. The lamp fixing and electrically connecting includes a first base, a second base, a first flexible portion, a second flexible portion, a third flexible portion, a fourth flexible portion, a first protrusion, a second protrusion, a third protrusion, and a fourth protrusion. The first and the second bases are interspaced to be disposed on the case. The first and the second flexible portions are bendably disposed on the first base, respectively. The first and the second flexible portions are interspaced to define a first aperture. The third and the fourth flexible portions are bendably disposed on the second base, respectively. The third and the fourth flexible portions are interspaced to define a second aperture. The first and the second protrusions are respectively disposed on the inner sides of the first and the second flexible portions, and are positioned above the first base. The third and the fourth protrusions are respectively disposed on the inner side of the third and the fourth flexible portions, and are positioned above the second base. When the first, the second, the third and the fourth flexible portions are in a natural state, the gap between the first and the second protrusions as well as the gap between the third and the fourth protrusions respectively are smaller than the diameter of the first electrode end and that of the second electrode end. When the first electrode end is moved towards the first base in the gap between the first and the second protrusions from the first aperture, and the second electrode end is moved towards the second base in the gap between the third and the fourth protrusions from the second aperture, the first electrode end presses the first and the second protrusions while the second electrode end presses the third and the fourth protrusions, so that the first, the second, the third and the fourth flexible portions swing outwardly, enabling the lamp clamping and electrically connecting device to receive the first and the second electrode ends. When the first electrode end passes through the first and the second protrusions and touches the first base, and the second electrode end passes through the third and the fourth protrusions and touches the second base, all of the first, the second, the third and the fourth flexible portions are restored to the natural state, so that the first protrusion, the second protrusion and the first base clamp the first electrode end from atop and underneath, and that the third protrusion, the fourth protrusion and the second base clamp the second electrode end from atop and underneath. The first and the second electrode ends are electrically connected to the lamp clamping and electrically connecting device.

According to still another object of the invention, a lamp clamping and electrically connecting device for fixing a lamp and being electrically connected to an electrode end of the lamp is provided. The lamp fixing and electrically connecting includes a base, a flexible portion, a fixing portion and a protrusion. The fixing portion is disposed on the base. The flexible portion is bendably disposed on the base and is interspaced with the fixing portion. The flexible portion and the fixing portion define an aperture. The protrusion is disposed on the inner side of the flexible portion, and is positioned above the base. When the flexible portion is in a natural state, the gap between the protrusion and the fixing portion is smaller than the diameter of the electrode end. When the electrode end is moved towards the base in the gap between the protrusion and the fixing portion from aperture, the electrode end presses the protrusion, so that the flexible portion swings outwardly, enabling the lamp clamping and electrically connecting device to receive the electrode end. When the electrode end touches base, the flexible portion is restored to the natural state, so that the protrusion, the fixing portion and the base clamp the electrode end from atop and underneath, and that the electrode end is electrically connected to the lamp clamping and electrically connecting device.

Other objects, features, and advantages of the invention will become apparent from the following detailed description of the preferred but non-limiting embodiments. The following description is made with reference to the accompanying drawings. Anyone who is skilled in related technology would be able to understand and implement the technology accordingly.

DETAILED DESCRIPTION OF THE INVENTION

First Embodiment

Figure 1A:
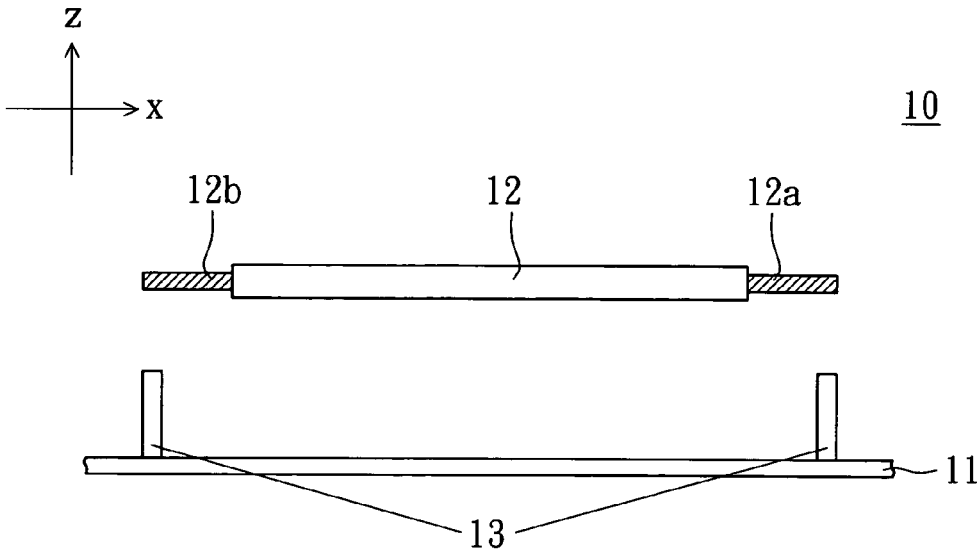
FIG. 1A is an exploded diagram of a case and a lamp clamping and electrically connecting device and lamp of a backlight module according to a first embodiment of the invention.
Figure 1B:
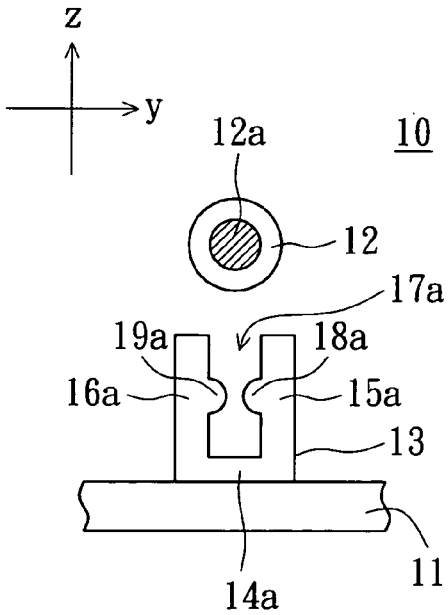
FIGS. 1B~1C respectively are an enlarged right side view and an enlarged left side view of the case and the lamp clamping and electrically connecting device and lamp of FIG. 1A.
Figure 1C:
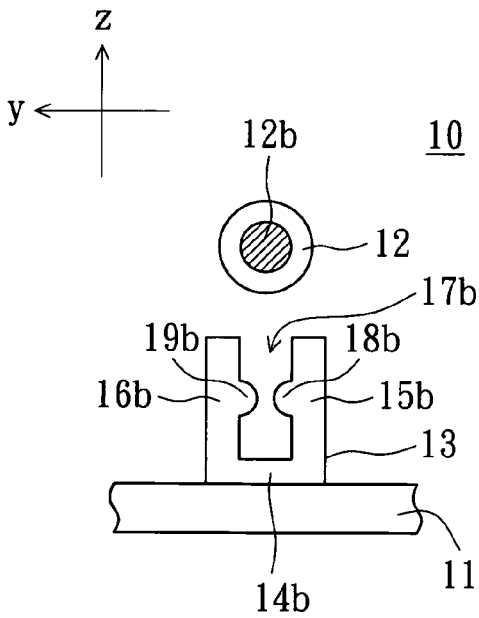

Referring to FIGS. 1A~1C at the same time, FIG. 1A is an exploded diagram of a case and a lamp clamping and electrically connecting device and lamp of a backlight module according to a first embodiment of the invention, while FIGS. 1B~1C respectively are an enlarged right side view and an enlarged left side view of the case and the lamp clamping and electrically connecting device and lamp of FIG. 1A. In FIGS. 1A~1C, the backlight module 10 at least includes a case 11, a lamp 12 and a lamp clamping and electrically connecting device 13. The lamp 12, via the lamp clamping and electrically connecting device 13, is buckled to be disposed on the case 11 and has a first electrode end 12*a* and a second electrode end 12*b*. The lamp clamping and electrically connecting device 13, which is disposed on the case 11 for the user to assemble the lamp 12 to or disassemble the lamp 12 from the case 11, is electrically connected to the first electrode end 12*a* and the second electrode end 12*b*. Besides, the position of the lamp fixing and electrically connecting 13 on the case 11 must correspond to the first electrode end 12*a* and the second electrode end 12*b* of the lamp 12. As for the structure of the lamp clamping and electrically connecting device 13 and the method of fixing the lamp 12 onto the case 11 are disclosed below.

The lamp fixing and electrically connecting 13 includes a first base 14*a*, a second base 14*b*, a first flexible portion 15*a*, a second flexible portion 16*a*, a third flexible portion 15*b*, a fourth flexible portion 16*b*, a first protrusion 18*a*, a second protrusion 19*a*, a third protrusion 18*b* and a fourth protrusion 19*b*. The first base 14*a* and the second base 14*b* respectively correspond to the first electrode end 12*a* and the second electrode end 12*b* of the lamp 12 and are interspaced to be disposed on the case 11. The first flexible portion 15*a* and the second flexible portion 16*a* are bendably disposed on the first base 14*a* and are interspaced to define a first aperture 17*a*. The third flexible portion 15*b* and the fourth flexible portion 16*b* are bendably disposed on the second base 14*b* and are interspaced to define a second aperture 17*b*. The first protrusion 18*a* and the second protrusion 19*a*, which are respectively disposed on the inner sides of the first flexible portion 15*a* and the second flexible portion 16*a*, are positioned above the first base 14*a* but within the first aperture 17*a*. The third protrusion 18*b* and the fourth protrusion 19*b*, which are respectively disposed on the inner sides of the third flexible portion 15*b* and the fourth flexible portion 16*b*, are positioned above the second base 14*b* but within the second aperture 17*b*.

When the lamp clamping and electrically connecting device 13 is in a natural state, the first flexible portion 15*a*, the second flexible portion 16*a*, the third flexible portion 15*b* and the fourth flexible portion 16*b* are in the natural state, both the shortest distance between the first protrusion 18*a* and the second protrusion 19*a* and the shortest distance between the third protrusion 18*b* and the fourth protrusion 19*b* are respectively smaller than the diameter of the first electrode end 12*a* and that of the second electrode end 12*b*. Moreover, both the shortest distance between the first protrusion 18*a* and the second protrusion 19*a* and the shortest distance between the third protrusion 18*b* and the fourth protrusion 19*b* are respectively smaller than the diameter of the first aperture 17*a* and that of the second aperture 17*b* as well.

As for the lamp assembling procedure of assembling the lamp 12 onto the case 11 via the lamp clamping and electrically connecting device 13 is disclosed in accompany of drawings below.

As shown in FIGS. 1A~1C, when the user would like to assemble the lamp 12 onto the case 11, firstly, the user has to hold the lamp 12 according to the extending direction, that is the x direction, and move the lamp 12 along the z direction, so that lamp 12 moves towards the case 11. The user has to align the first electrode end 12*a* and the second electrode end 12*b* of the lamp 12 to be respectively corresponding to the clearance between the first flexible portion 15*a* and the second flexible portion 16*a* and the clearance between the third flexible portion 15*b* and the fourth flexible portion 16*b*, that are, the first aperture 17*a* and the second aperture 17*b* respectively.

Figure 2A:
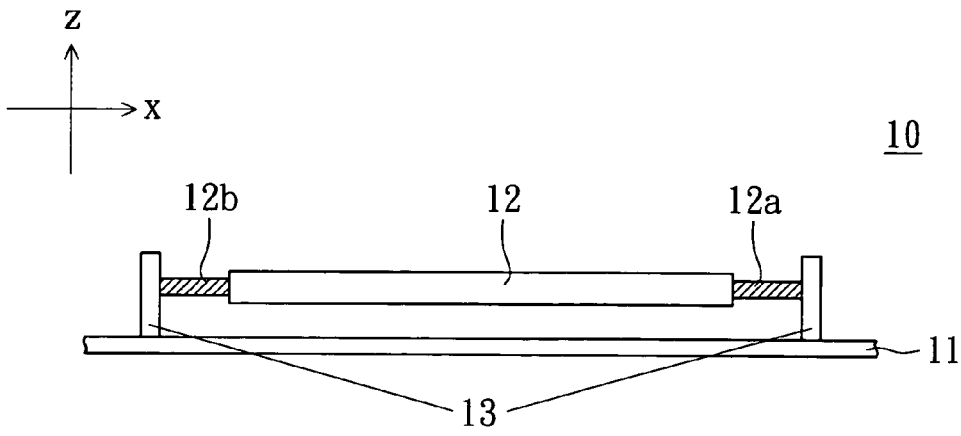
FIG. 2A is an assembly diagram showing the state when the electrode end of the lamp of FIG. 1 presses the lamp clamping and electrically connecting device.
Figure 2B:
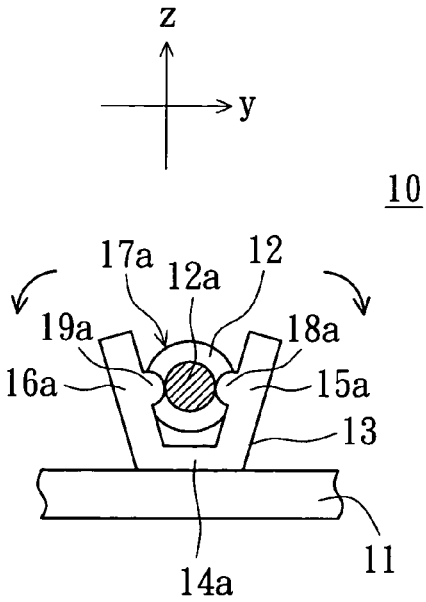
FIGS. 2B~2C respectively are an enlarged right side view and an enlarged left side view of the case and the lamp clamping and electrically connecting device and lamp of FIG. 2A.
Figure 2C:
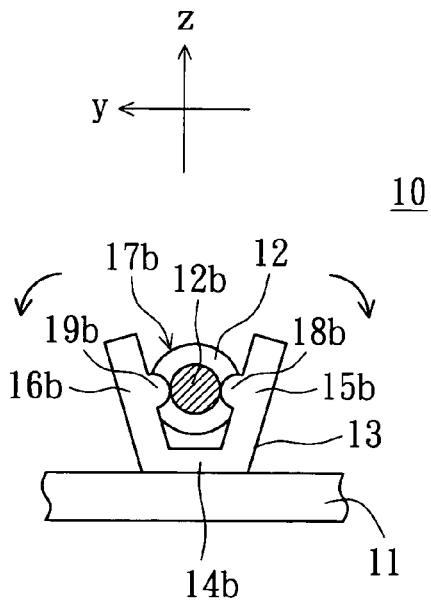

Next, as shown in FIGS. 2A~2C, the first electrode end 12*a* is moved towards the first base 14*a* from the first aperture 17*a* in the gap between the first protrusion 18*a* and the second protrusion 19*a*, and the second electrode end 12*b* is moved towards the second base 14*b* from the second aperture 17*b* in the gap between the third protrusion 18*b* and the fourth protrusion 19*b*. The shortest distance between the first protrusion 18*a* and the second protrusion 19*a* and the shortest distance between the third protrusion 18*b* and the fourth protrusion 19*b* respectively are smaller than the diameter of the first electrode end 12*a* and that of the second electrode end 12*b*. If the user continues to apply a force, the first electrode end 12*a* would be enabled to touch and press the first protrusion 18*a* and the second protrusion 19*a* while the second electrode end 12*b* would be enabled to touch and press the third protrusion 18*b* and the fourth protrusion 19*b*. By doing so, all of the first protrusion 18*a*, the second protrusion 19*a*, the third protrusion 18*b* and the fourth protrusion 19*b* would swing outwardly from the two lateral sides along the swinging arrows of FIGS. 2B~2C, and the first aperture 17*a* and the second aperture 17*b* would be expanded, enabling the lamp clamping and electrically connecting device 13 to receive the first electrode end 12*a* and the second electrode end 12*b*. In other word, the first flexible portion 15*a*, the second flexible portion 16*a*, the third flexible portion 15*b* and the fourth flexible portion 16*b* would swing outwardly from the two lateral sides along the swinging arrows of FIGS. 2B~2C.

Figure 3A:
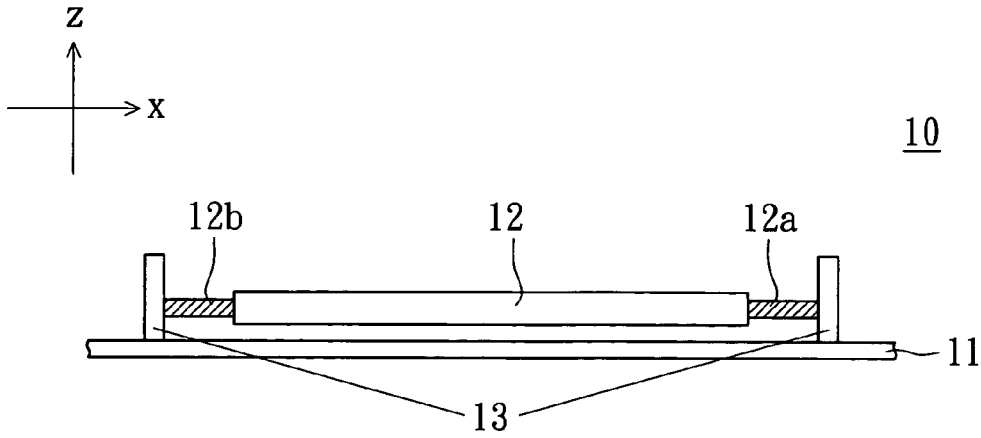
FIG. 3A is an assembly diagram showing the state when the lamp clamping and electrically connecting device of FIG. 2A clamps the electrode end of the lamp.
Figure 3B:
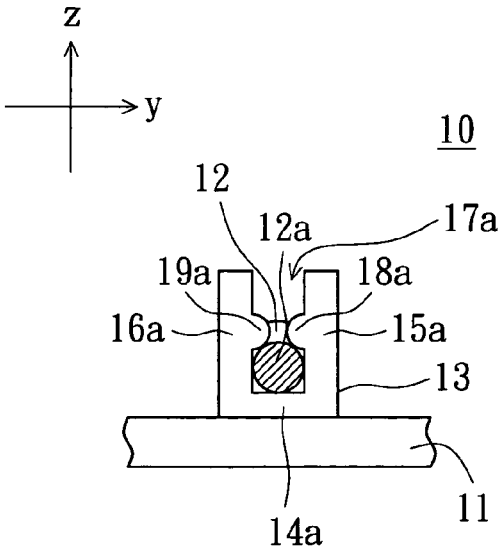
FIGS. 3B~3C respectively are an enlarged right side view and an enlarged left side view of the case and the lamp clamping and electrically connecting device and lamp of FIG. 3A.
Figure 3C:
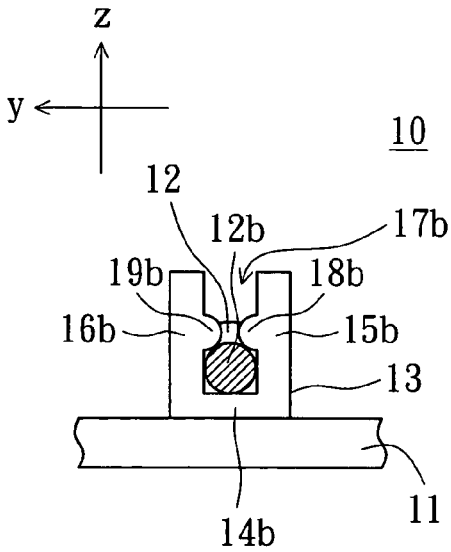

Then, as shown in FIGS. 3A~3C, the user continues to apply a force to the lamp 12 for the first electrode end 12*a* to pass through the first protrusion 18*a* and the second protrusion 19*a* and touches the first base 14*a*, and for the second electrode end 12*b* to pass through the third protrusion 18*b* and the fourth protrusion 19*b* and touch the second base 14*b*, then all of the first protrusion 18*a*, the second protrusion 19*a*, the third protrusion 18*b* and the fourth protrusion 19*b* would be restored to the above-disclosed natural state. In other word, the first flexible portion 15*a*, the second flexible portion 16*a*, the third flexible portion 15*b* and the fourth flexible portion 16*b* are resorted to the natural state. That is, the shortest distance between the first protrusion 18*a* and the second protrusion 19*a* and the shortest distance between the third protrusion 18*b* and the fourth protrusion 19*b* respectively are smaller than the diameter of the first electrode end 12*a* and that of the second electrode end 12*b*, and the first aperture 17*a* and the second aperture 17*b* would be restored to the original size. By doing so, the first protrusion 18*a*, the second protrusion 19*a* and the first base 14*a* would clamp the first electrode end from atop and underneath 12*a*, the third protrusion 18*b*, the fourth protrusion 19*b* and the second base 14*b* would clamp the second electrode end from atop and underneath 12*b*, and the first electrode end 12*a* and the second electrode end 12*b* are electrically connected to the lamp clamping and electrically connecting device 13.

Since the shortest distance between the first protrusion 18*a* and the second protrusion 19*a* and the shortest distance between the third protrusion 18*b* and the fourth protrusion 19*b* respectively are smaller than the diameter of the first electrode end 12*a* and that of the second electrode end 12*b*, the lamp clamping and electrically connecting device 13 would firmly and quickly fix the lamp 12 on the case 11, lest the lamp 12 might be detached or disassembled from the lamp clamping and electrically connecting device 13 on the case 11.

To the contrary, when the user would like to disassemble the lamp 12 from the case 11, the user only needs to reverse the above-disclosed lamp assembling procedure, the lamp 12 can be easily detached and disassembled from the lamp clamping and electrically connecting device 13. This is the lamp disassembling procedure.

As shown in FIGS. 3A~3C, when the user applies a force onto the lamp 12, the first electrode end 12*a* is moved away from the first base 14*a* from the first base 14*a* in the gap between the first protrusion 18*a* and the second protrusion 19*a*, and the second electrode end 12*b* is moved away from the second base 14*b* from the second base 14*b* in the gap between the third protrusion 18*b* and the fourth protrusion 19*b*, the first electrode end 12*a* presses the first protrusion 18*a* and the second protrusion 19*a*, the second electrode end 12*b* presses the third protrusion 18*b* and the fourth protrusion 19*b*. By doing so, all of the first protrusion 18*a*, the second protrusion 19*a*, the third protrusion 18*b* and the fourth protrusion 19*b* swing outwardly from the two lateral sides, so that the first electrode end 12*a* and the second electrode end 12*b* are enabled to separate from the lamp clamping and electrically connecting device 13 as shown in FIGS. 2A~2C.

The user continues to apply a force onto the lamp 12 for the first electrode end 12*a* to pass through the first protrusion 18*a* and the second protrusion 19*a* to be moved away from the first base 14*a* and for the second electrode end 12*b* to pass through the third protrusion 18*b* and the fourth protrusion 19*b* to be moved away from the second base 14*b*. By doing so, the first protrusion 18*a*, the second protrusion 19*a*, the third protrusion 18*b* and the fourth protrusion 19*b* are restored to the natural state, and the lamp 12 is detached from the lamp clamping and electrically connecting device 13 as shown in FIGS. 1A~1C.

However, anyone who has basic knowledge relevant to the scope of technology of the present embodiment will understand that the scope of technology of the present embodiment is not to be limited thereto. For example, the lamp 12 is moved towards or away from the first base 14*a* and the second base 14*b* along the normal direction (z direction for instance) of the surface of the first base 14*a* or the second base 14*b*, the tube of the lamp 12 is perpendicular to the normal direction of the surface of the first base 14*a* or the second base 14*b*, and the tube of the lamp 12 extends along the x direction. Besides, the lamp clamping and electrically connecting device 13 contains metal. The structures of the first base 14*a*, the first flexible portion 15*a*, the second flexible portion 16*a*, the first protrusion 18*a* and the second protrusion 19*a* are formed in one piece. The structures of the second base 14*b*, the third flexible portion 15*b*, the fourth flexible portion 16*b*, the third protrusion 18*b* and the fourth protrusion 19*b* are integrally formed in one piece. Besides, the first flexible portion 15*a*, the second flexible portion 16*a*, the third flexible portion 15*b* and the fourth flexible portion 16*b* can be four metal elastic sheets, while the first protrusion 18*a*, the second protrusion 19*a*, the third protrusion 18*b* and the fourth protrusion 19*b* can be four metal protrusions.

In the present embodiment, the lamp clamping and electrically connecting device 13 can be disposed on a circuit board and be electrically connected to a lamp inverter via a circuit layout of the circuit board. Alternatively, the lamp clamping and electrically connecting device 13 is electrically connected to the lamp inverter through the routing of the conducting wire. The lamp inverter would receive a power source and drive the lamp 12 to illuminate via a circuit board or a conducting wire.

Despite the lamp 12 of the present embodiment is exemplified by but not limited to the straight type lamp. The lamps of other shapes, a U-shaped lamp for instance, is applicable as well. By aligning the lamp clamping and electrically connecting device 13 to be corresponding to the two electrode ends of the U-shaped lamp, the U-shaped lamp can be firmly fixed on the case 11.

In the present embodiment, the lamp clamping and electrically connecting device 13 is disposed on the case 11 of the backlight module 10 to clamp and electrically connect the lamp 12. However, the lamp clamping and electrically connecting device 13 can also be applied to other illuminating devices, which have to clamp and electrically connect the lamp.

According to the present embodiment, the design of vertically and downwardly embedding the lamp 12 into and upwardly removing the lamp 12 from the lamp clamping and electrically connecting device 13 enables the lamp 12 to be electrically connected to the lamp clamping and electrically connecting device 13 when the lamp 12 is embedded into the lamp clamping and electrically connecting device 13, transcending the restrain imposed in conventional design that the lamp is soldered onto the case together with the conducting wire. Consequently, the lamp can be replaced within a short period of time, dispensing the de-soldering and the soldering steps, which are very time-consuming. So, the invention not only greatly simplifies the procedure of assembling and disassembling the lamp, but also reduces the hours required for assembling and disassembling the lamp, which is indeed very economical.

Second Embodiment

Figure 4A:
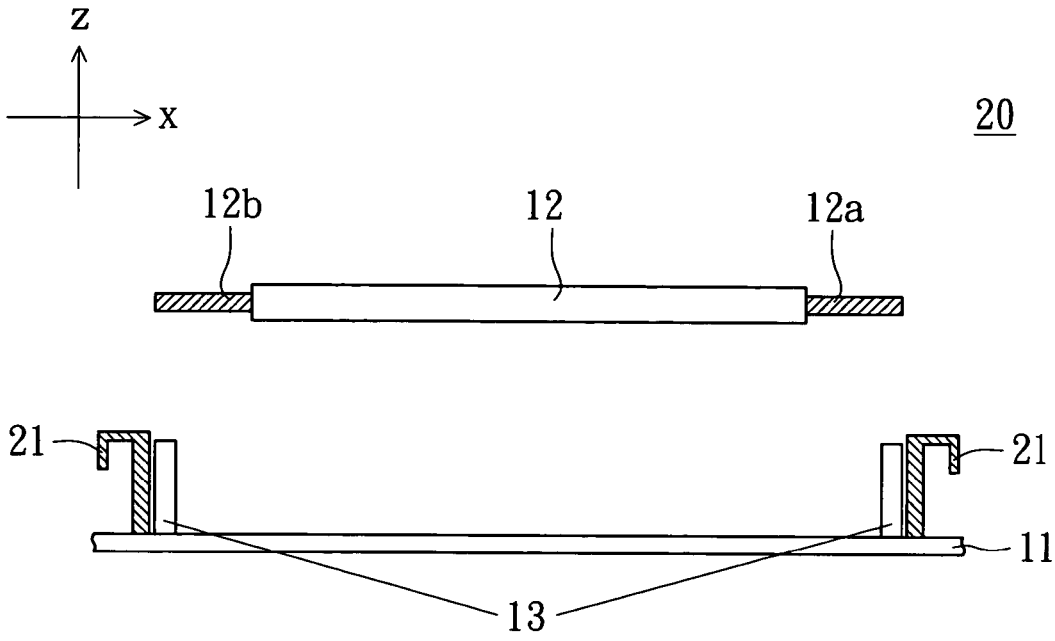
FIG. 4A is an exploded diagram of a case and a lamp clamping and electrically connecting device and lamp of a backlight module according to a second embodiment of the invention.
Figure 4B:
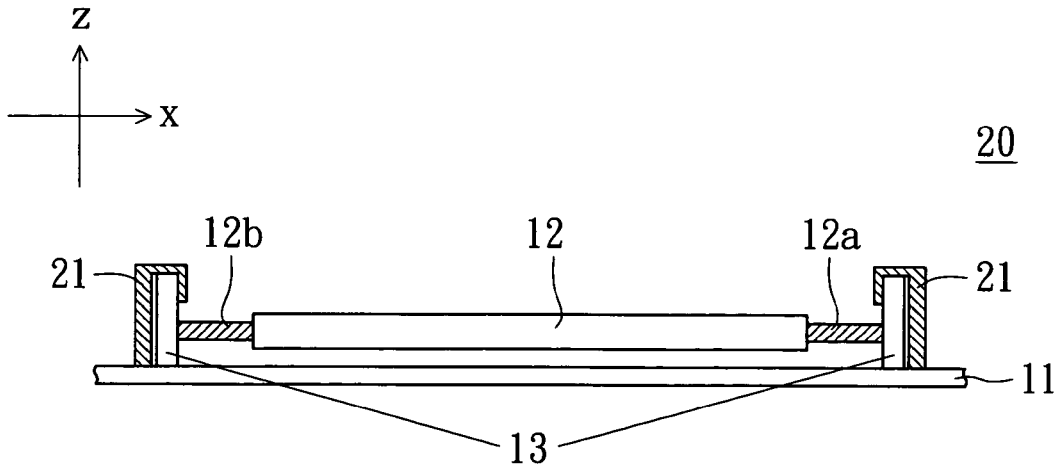
FIG. 4B is an assembly diagram showing the state when the insulation protective cover covers the lamp clamping and electrically connecting device and the electrode end of the lamp.

Referring to both FIGS. 4A~4B, FIG. 4A is an exploded diagram of a case and a lamp clamping and electrically connecting device and lamp of a backlight module according to a second embodiment of the invention, while FIG. 4B is an assembly diagram showing the state when the insulation protective cover covers the lamp clamping and electrically connecting device and the electrode end of the lamp. The backlight module 20 of the present embodiment differs with the backlight module 10 of the first embodiment in the insulation protective cover 21, which is used for receiving lamp clamping and electrically connecting device 13. As for other similar components, the same labeling is used and is not repeated here.

In FIG. 4A, an insulation protective cover 21 is rotatably disposed on the case 11 and is adjacent to the lamp clamping and electrically connecting device 13. In a natural state, the insulation protective cover 21 covers the lamp clamping and electrically connecting device 13. If the insulation protective cover 21 has already covered the lamp clamping and electrically connecting device 13 before the user would like to buckle the lamp 12 into the lamp clamping and electrically connecting device 13 or remove the lamp 12 from the lamp clamping and electrically connecting device 13, the user has to remove the insulation protective cover 21 first before the lamp assembling procedure or the lamp disassembling procedure can be performed.

As shown in FIG. 4B, when lamp clamping and electrically connecting device 13 clamps the lamp 12 on the case 11, the user can turn the insulation protective cover 21 over, so that insulation protective cover 21 covers the electrical connecting point between the lamp clamping and electrically connecting device 13 and the first electrode end 12*a* and the second electrode end 12*b* of the lamp 12. On one hand, the electrical connecting point between the lamp clamping and electrically connecting device 13 and the first electrode end 12*a* and the second electrode end 12*b* of the lamp 12 can be isolated from the external area. On the other hand, on the case 11, the detachment or separation between the first electrode end 12*a* and the second electrode end 12*b* of the lamp 12 and the lamp clamping and electrically connecting device 13 can be prevented If the user would like to disassemble the lamp 12 form the case 11 when covered the lamp clamping and electrically connecting device 13 is already covered by the insulation protective cover 21, firstly, the user must move the insulation protective cover 21 disposed on the lamp clamping and electrically connecting device 13 away, so that insulation protective cover 21 can be restored to the natural state. Next, if the user would like to disassemble the lamp 12 from the case 11, the user only needs to follow the above-disclosed lamp disassembling procedure, the lamp 12 can be easily detached and disassembled from the lamp clamping and electrically connecting device 13.

However, anyone who has basic knowledge relevant to the scope of technology of the present embodiment will understand that the scope of technology of the present embodiment is not to be limited thereto. For example, without affecting the lamp 12 to be assembled onto or disassembled from the case 11 via lamp clamping and electrically connecting device, the insulation protective cover can be disposed on the lamp clamping and electrically connecting device 13. When the lamp clamping and electrically connecting device 13 clamps the lamp 12 on the case 11, the user can turn the insulation protective cover 21 over for the insulation protective cover 21 covers to cover the electrically connecting point between the lamp clamping and electrically connecting device 13 and the first electrode end 12*a* and the second electrode end 12*b* of the lamp 12.

Besides, the insulation protective cover 21 does not necessarily to be disposed on the case 11 and the lamp clamping and electrically connecting device 13. That is, the insulation protective cover 21 can be a separate and individual part. When the lamp clamping and electrically connecting device 13 clamps and electrically connects the lamp 12 on the case 11, the user can use the insulation protective cover 21 to directly cover the electrically connecting point between the lamp clamping and electrically connecting device 13 and the first electrode end 12*a* and the second electrode end 12*b* of the lamp 12.

Third Embodiment

Figure 5:
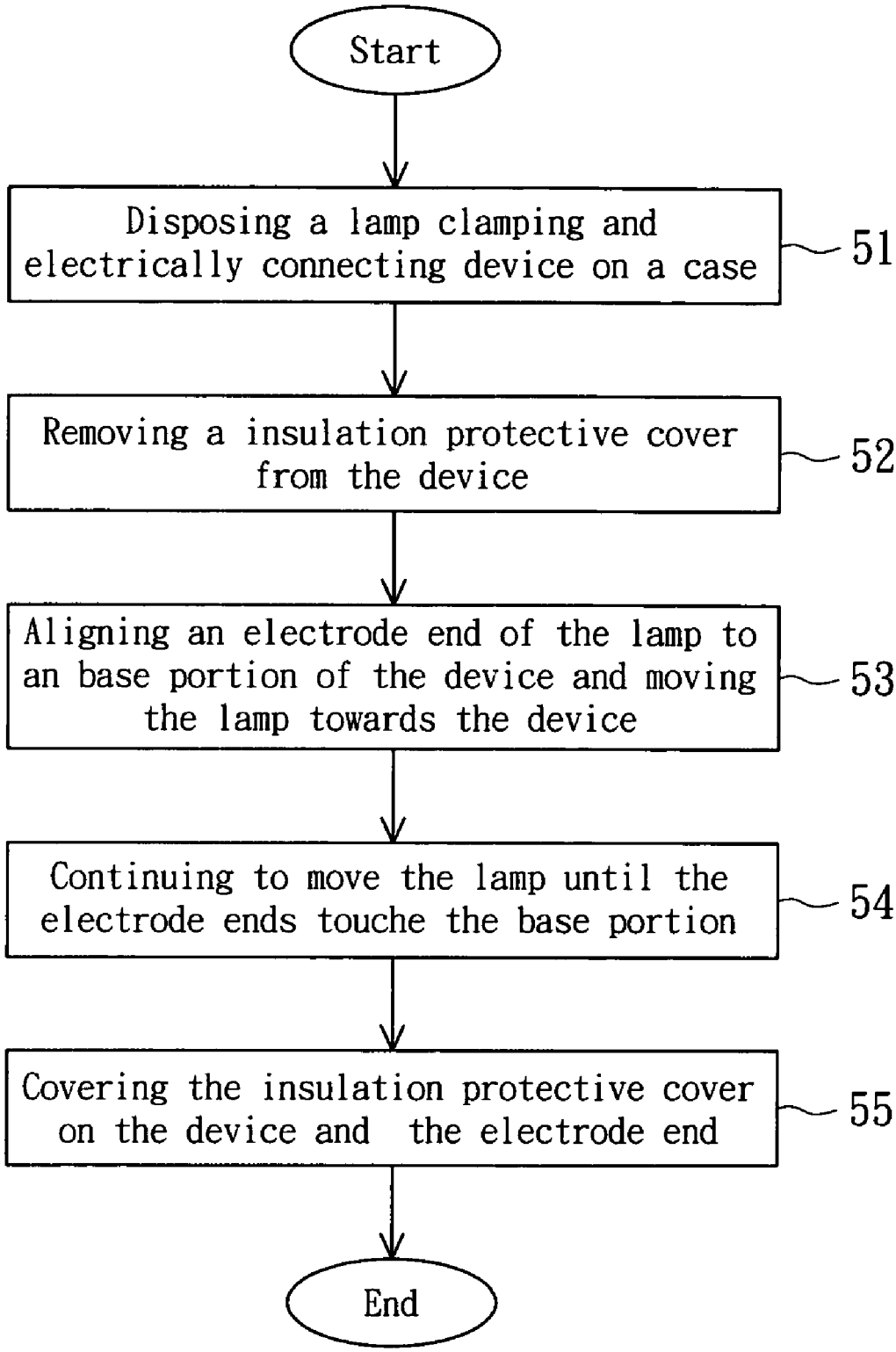
FIG. 5 is a diagram of the lamp assembling procedure of a lamp assembling and disassembling method according to a third embodiment of the invention.

Referring to FIG. 5, a diagram of the lamp assembling procedure of a lamp assembling and disassembling method according to a third embodiment of the invention is shown. Referring to FIGS. 1A~4B, the lamp assembling and disassembling method of the present embodiment is used for a lamp 12 to be assembled onto or disassembled from the case 11 of backlight modules 10 and 20. The lamp 12 has a first electrode end 12*a* and a second electrode end 12*b*. The present embodiment is exemplified by the backlight module 20.

At first, the method begins at step 51, a lamp clamping and electrically connecting device 13 is disposed on the case 11. The lamp clamping and electrically connecting device 13 includes a first base 14*a* and a second base 14*b*, a first flexible portion 15*a* and a second flexible portion 16*a*, a third flexible portion 15*b* and a fourth flexible portion 16*b*, a first protrusion 18*a*, a second protrusion 19*a*, a third protrusion 18*b* and a fourth protrusion 19*b*. The first base 14*a* and a second base 14*b* are interspaced. The first flexible portion 15*a* and the second flexible portion 16*a* are bendable on the first base 14*a* and are interspaced at an interval of a first aperture 17*a*. The third flexible portion 15*b* and the fourth flexible portion 16*b* are bendable on the second base 14*b* and are interspaced at an interval of a second aperture 17*b*. The first protrusion 18*a*, the second protrusion 19*a*, the third protrusion 18*b* and the fourth protrusion 19*b* are respectively disposed on the inner sides of the first flexible portion 15*a*, the second flexible portion 16*a*, the third flexible portion 15*b* and the fourth flexible portion 16*b*. The first protrusion 18*a* and the second protrusion 19*a* are positioned in the first aperture 17*a*. The third protrusion 18*b* and the fourth protrusion 19*b* are positioned in the second aperture 17*b*. In a natural state, the shortest distance between the first protrusion 18*a* and the second protrusion 19*a* and the shortest distance between the third protrusion 18*b* and the fourth protrusion 19*b* respectively are smaller than the diameter of the first electrode end 12*a* and that of the second electrode end 12*b*. Moreover, the shortest distance between the first protrusion 18*a* and the second protrusion 19*a* and the shortest distance between the third protrusion 18*b* and the fourth protrusion 19*b* respectively are smaller than the size of the first aperture 17*a* and that of the second aperture 17*b*. Besides, the backlight module 20 further includes an insulation protective cover 21 for receiving lamp clamping and electrically connecting device 13. Besides, the insulation protective cover 21 is rotatably disposed on the case 11 and adjacent to the lamp clamping and electrically connecting device 13. In the present embodiment, the insulation protective cover 21 is supposed to have covered the lamp clamping and electrically connecting device 13 before the lamp 12 is buckled into the lamp clamping and electrically connecting device 13. Next, proceed to step 52, the insulation protective cover 21 disposed on the lamp clamping and electrically connecting device 13 is removed.

Then, proceed to step 53, aligning the first electrode end 12*a* and the second electrode end 12*b* of the lamp 12 to be respectively corresponding to the first base 14*a* and the second base 14*b* for the lamp 12 to be moved towards the lamp clamping and electrically connecting device 13. That is, the first electrode end 12*a* is moved towards the first base 14*a* in the gap between the first protrusion 18*a* and the second protrusion 19*a* from the first aperture 17*a*, and the second electrode end 12*b* is moved towards the second base 14*b* in the gap between the third protrusion 18*b* and the fourth protrusion 19*b* from the second aperture 17*b*. Both the shortest distance between the first protrusion 18*a* and the second protrusion 19*a* and the shortest distance between the third protrusion 18*b* and the fourth protrusion 19*b* are respectively smaller than the diameter of the first electrode end 12*a* and that of the second electrode end 12*b*. The first electrode end 12*a* presses the first protrusion 18*a* and the second protrusion 19*a*, and the second electrode end 12*b* presses the third protrusion 18*b* and the fourth protrusion 19*b*. By doing so, all of the first protrusion 18*a*, the second protrusion 19*a*, the third protrusion 18*b* and the fourth protrusion 19*b* would swing outwardly, and the size of the first aperture 17*a* and the second aperture 17*b* would be expanded, enabling the lamp clamping and electrically connecting device 13 to receive the first electrode end 12*a* and the second electrode end 12*b*. Besides, the lamp 12 approaches the first base 14*a* and the second base 14*b* along the first base 14*a* or along the normal direction (z direction for instance) of the surface of the second base 14*b*, the tube of the lamp 12 is perpendicular to the normal direction of the surface of the first base 14*a* or the second base 14*b*, and the tube of the lamp 12 extends along the x direction for instance.

Next, proceed to step 54, continue to move the lamp 12 until the first electrode end 12*a* and the second electrode end 12*b* respectively touch the first base 14*a* and the second base 14*b*. That is, until the first electrode end 12*a* passes through the first protrusion 18*a* and the second protrusion 19*a* to touch the first base 14*a* and until the second electrode end 12*b* passes through the third protrusion 18*b* and the fourth protrusion 19*b* to touch the second base 14*b*. Meanwhile, all of the first protrusion 18*a*, the second protrusion 19*a*, the third protrusion 18*b* and the fourth protrusion 19*b* are restored to the natural state, and both the first aperture 17*a* and the second aperture 17*b* are restored to the original size. The first protrusion 18*a*, the second protrusion 19*a* and the first base 14*a* clamp the first electrode end from atop and underneath 12*a*. The third protrusion 18*b*, the fourth protrusion 19*b* and the second base 14*b* clamp the second electrode end from atop and underneath 12*b*. The first electrode end 12*a* and the second electrode end 12*b* are electrically connected to the lamp clamping and electrically connecting device 13. Then, proceed to step 55, the insulation protective cover 21 is covered by the lamp clamping and electrically connecting device 13 to envelop the first electrode end 12*a* and the second electrode end 12*b*. The lamp assembling procedure is terminated here.

If the lamp 12 of the case 11 is damaged, the user only needs to reverse the above-disclosed lamp assembling procedure, and the lamp 12 can be easily and quickly detached from the lamp clamping and electrically connecting device 13. Moreover, the user can assemble a new lamp onto the case via the lamp clamping and electrically connecting device 13 according to the above-disclosed lamp assembling procedure. The lamp disassembling procedure is disclosed below in accompany of drawings.

Figure 6:
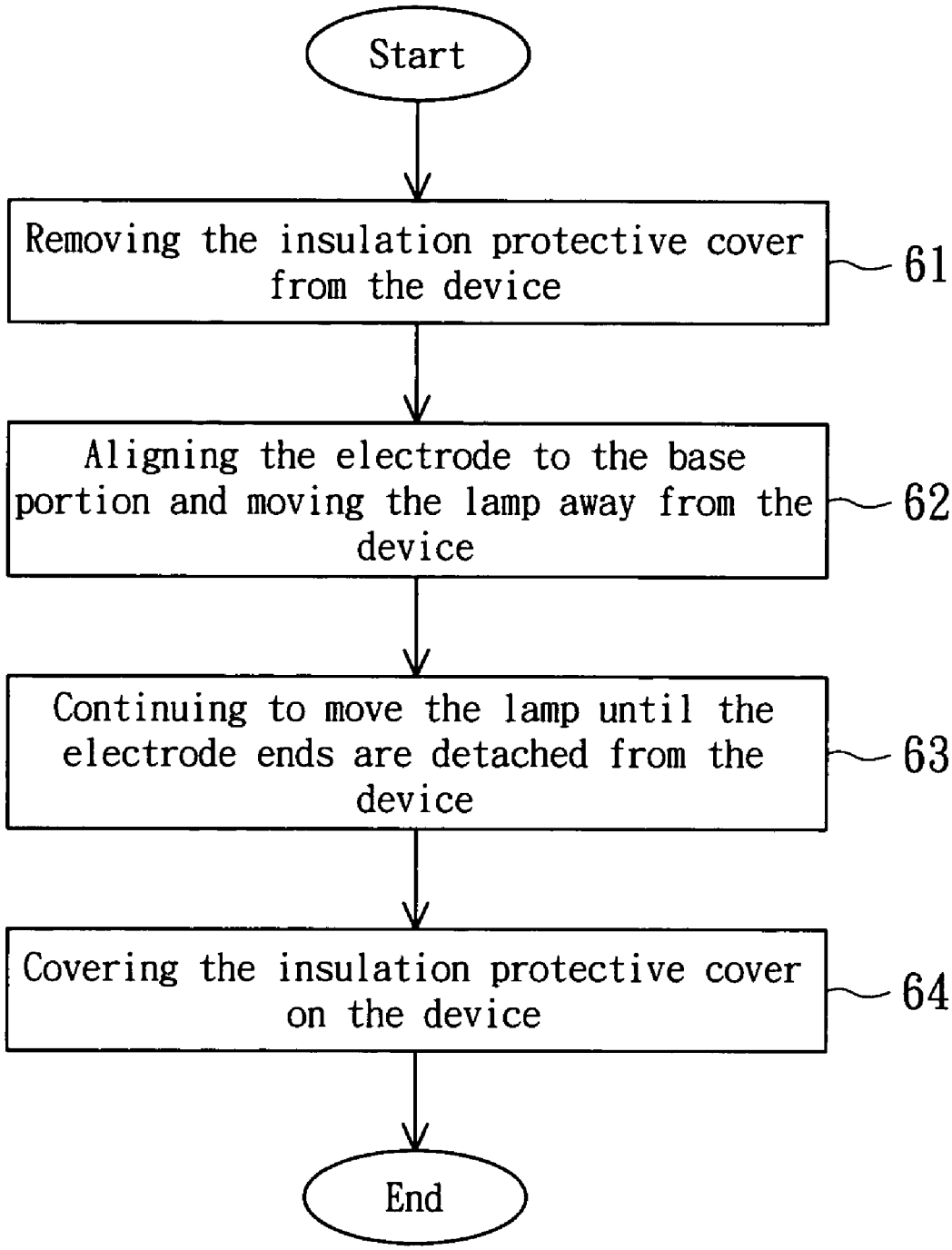
FIG. 6 is a diagram of the lamp disassembling procedure of a lamp assembling and disassembling method according to a third embodiment of the invention.

As shown in FIG. 6, at first, the method begins at step 61, the insulation protective cover 21 is removed. Next, proceed to step 62, the first electrode end 12*a* is moved away from the first base 14*a* in the gap between the first protrusion 18*a* and the second protrusion 19*a*, and the second electrode end 12*b* is moved away from the second base 14*b* in the gap between the third protrusion 18*b* and the fourth protrusion 19*b*. The first electrode end 12*a* presses the first protrusion 18*a* and the second protrusion 19*a*, and the second electrode end 12*b* presses the third protrusion 18*b* and the fourth protrusion 19*b*. The first protrusion 18*a*, the second protrusion 19*a*, the third protrusion 18*b* and the fourth protrusion 19*b* swing outwardly and enable the first electrode end 12*a* and the second electrode end 12*b* to move away from the lamp clamping and electrically connecting device 13. Besides, the lamp 12 is moved away from the first base 14*a* and the second base 14*b* along the normal direction (z direction for instance) of the surface of the first base 14*a* or the second base 14*b*, the tube of the lamp 12 is perpendicular to the normal direction of the surface of the first base 14*a* or the second base 14*b*, and the tube of the lamp 12 extends along the x direction.

Then, proceed to step 63, continue to move the lamp 12 until the first electrode end 12*a* passes through the first protrusion 18*a* and the second protrusion 19*a* to move away from the first base 14*a* and until the second electrode end 12*b* passes through the third protrusion 18*b* and the fourth protrusion 19*b* to move away from the second base 14*b*. All of the first protrusion 18*a*, the second protrusion 19*a*, the third protrusion 18*b* and the fourth protrusion 19*b* are restored to the natural state, and the lamp 12 is detached from the lamp clamping and electrically connecting device 13. Next, proceed to step 64 if the lamp 12 is already completely detached from the lamp clamping and electrically connecting device 13. The insulation protective cover 21 covers the lamp clamping and electrically connecting device 13, and the lamp disassembling procedure of the lamp 12 is completed. Alternatively, after the lamp 12 is completely detached from the lamp clamping and electrically connecting device 13, the lamp assembling procedure for a new lamp is performed.

Fourth Embodiment

Figure 7A:
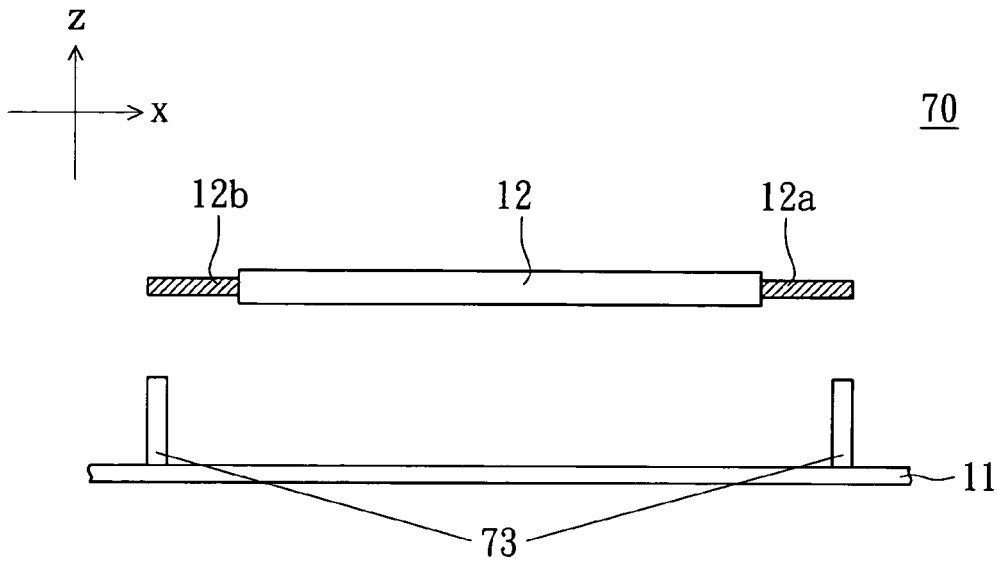
FIG. 7A is an exploded diagram of a case and a lamp clamping and electrically connecting device and lamp of a backlight module according to the invention of the fourth embodiment.
Figure 7B:
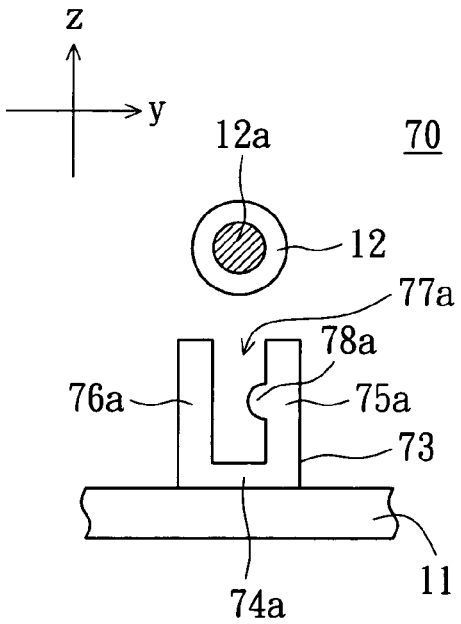
FIGS. 7B~7C respectively are an enlarged right side view and an enlarged left side view of the case and the lamp clamping and electrically connecting device and lamp of FIG. 7A.
Figure 7C:
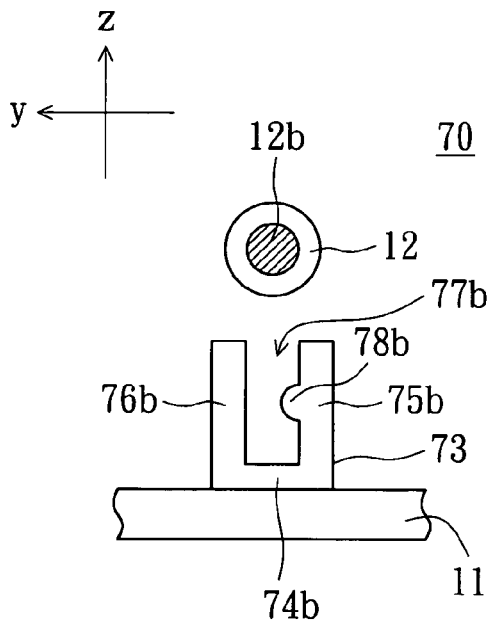

Referring to both FIGS. 7A~7C, FIG. 7A is an exploded diagram of a case and a lamp clamping and electrically connecting device and lamp of a backlight module according to the invention of the fourth embodiment, while FIGS. 7B~7C respectively are an enlarged right side view and an enlarged left side view of the case and the lamp clamping and electrically connecting device and lamp of FIG. 7A. The backlight module 70 of the present embodiment differs with the backlight module 10 of the first embodiment in the lamp clamping and electrically connecting device 73. As for other similar components, the same labeling is used and is not repeated here.

In FIGS. 7~7C, the lamp fixing and electrically connecting 73 includes a first base 74*a*, a second base 74*b*, a first flexible portion 75*a*, a first fixing portion 76*a*, a second flexible portion 75*b*, a second fixing portion 76*b*, a first protrusion 78*a* and a second protrusion 78*b*. The first base 74*a* and the second base 74*b*, respectively corresponding to the first electrode end 12*a* and the second electrode end 12*b* of the lamp 12, are interspaced to be disposed on the case 11. The first fixing portion 76*a* and the second fixing portion 76*b* are respectively disposed on the first base 74*a* and the second base 74*b*. The first flexible portion 75*a* and the second flexible portion 75*b* respectively are bendably to be disposed on the first base 74*a* and the second base. The first fixing portion 76*a* and the first flexible portion 75*a* are interspaced to define a first aperture 77*a*. The second fixing portion 76*b* and the second flexible portion 75*b* are interspaced to define a second aperture 77*b*. The first protrusion 78*a* and the second protrusion 78*b*, which are respectively disposed on the inner sides of the first flexible portion 75*a* and the second flexible portion 75*b*, are respectively positioned above the first base 74*a* and the second base 74*b*. The first protrusion 78*a* and the second protrusion 78*b* are respectively positioned within the first aperture 77*a* and the second aperture 77*b*.

When the lamp clamping and electrically connecting device 73 is in a natural state, the first flexible portion 75*a* and the second flexible portion 75*b* are in the natural state, the shortest distance between the first protrusion 78*a* and the first fixing portion 76*a* and the shortest distance between the second protrusion 78*b* and the second fixing portion 76*b* respectively are smaller than the diameter of the first electrode end 12*a* and that of the second electrode end 12*b*. Moreover, both the shortest distance between the first protrusion 78*a* and the first fixing portion 76*a* and the shortest distance between the second protrusion 78*b* and the second fixing portion 76*b* are respectively smaller than the size of the first aperture 77*a* and that of the second aperture 77*b* as well.

As for the lamp assembling procedure of assembling the lamp 12 onto the case 11 via the lamp clamping and electrically connecting device 73 is disclosed in accompany of drawings below As shown in FIGS. 7A~7C, when the user would like to assemble the lamp 12 onto the case 11, firstly, the user has to hold the lamp 12 according to the extending direction, that is the x direction, and move the lamp 12 along the z direction, so that lamp 12 moves towards the case 11. The user has to align the first electrode end 12*a* and the second electrode end 12*b* of the lamp 12 to be respectively corresponding to the first aperture 77*a* and the second aperture 77*b*.

Figure 8A:
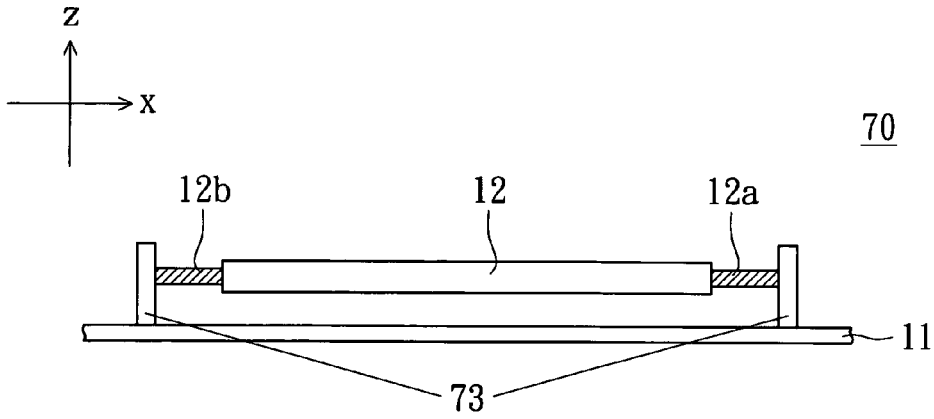
FIG. 8A is an assembly diagram showing the state when the electrode end of the lamp of FIG. 8A presses the lamp clamping and electrically connecting device.
Figure 8B:
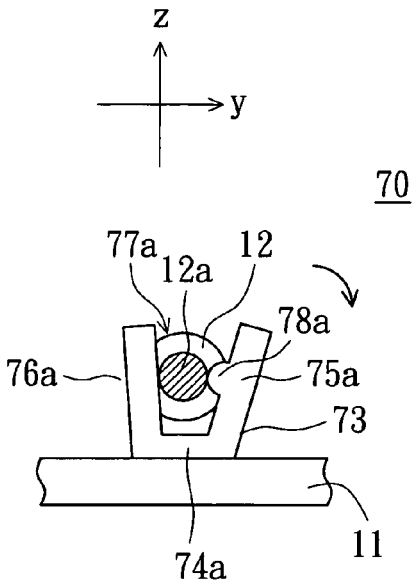
FIGS. 8B~8C respectively are an enlarged right side view and an enlarged left side view of the case and the lamp clamping and electrically connecting device and lamp of FIG. 8A.
Figure 8C:
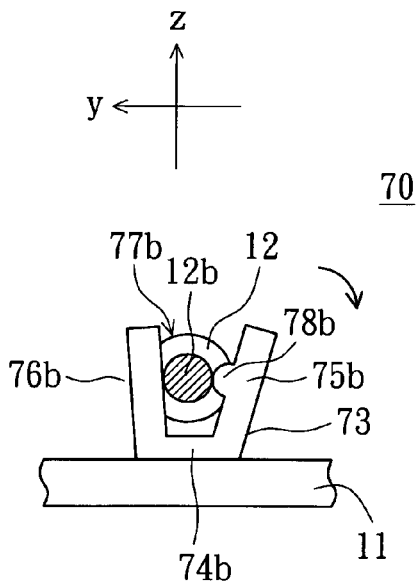

Next, as shown in FIGS. 8A~8C, if the user continues to apply a force when the first electrode end 12*a* is moved towards the first base 74*a* in the gap between the first protrusion 78*a* and the first fixing portion 76*a* from the first aperture 77*a*, and when the second electrode end 12*b* is moved towards the second base 74*b* in the gap between the second protrusion 78*b* and the second fixing portion 76*b* from the second aperture 77*b*, the first electrode end 12*a* would press the first protrusion 78*a*, while the second electrode end 12*b* would press the second protrusion 78*b*. By doing so, both the first protrusion 78*a* and the second protrusion 78*b* swing outwardly towards one lateral side along the swinging arrow of FIGS. 8B~8C, and the first aperture 77*a* and the second aperture 77*b* would be expanded, enabling the lamp clamping and electrically connecting device 73 to receive the first electrode end 12*a* and the second electrode end 12*b*. In other word, the first flexible portion 75*a* and the second flexible portion 75*b* swing outwardly towards one lateral side along the swinging arrow of FIGS. 8B~8C.

Figure 9A:
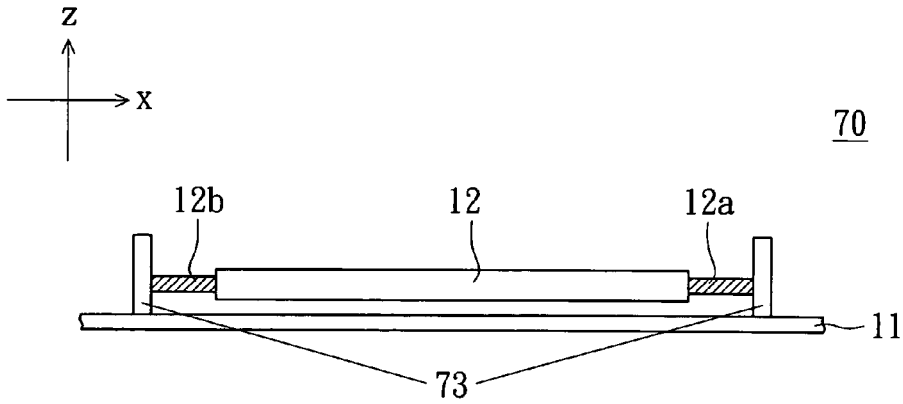
FIG. 9A is an assembly diagram showing the state when the lamp clamping and electrically connecting device of FIG. 9A clamps the electrode end of the lamp.
Figure 9B:
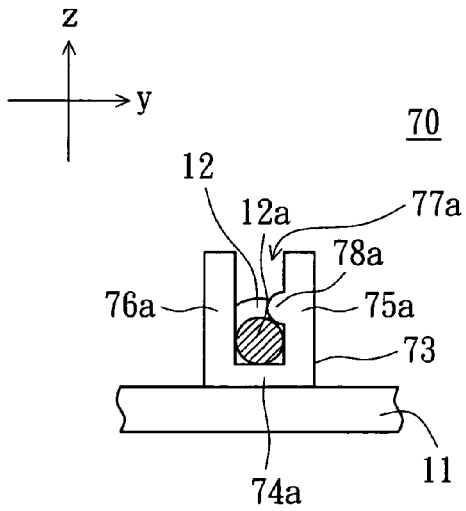
FIGS. 9B~9C respectively are an enlarged right side view and an enlarged left side view of the case and the lamp clamping and electrically connecting device and lamp of FIG. 9A.
Figure 9C:
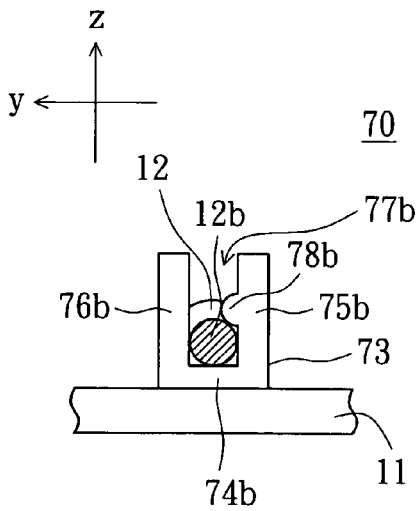

Then, as shown in FIGS. 9A~9C, if the user continues to apply a force onto the lamp 12 for the first electrode end 12*a* to touch the first base 74*a* and for the second electrode end 12*b* to touch the second base 74*b*, the first protrusion 78*a* and the second protrusion 78*b* would be restored to the above-disclosed natural state while the first aperture 77*a* and the second aperture 77*b* would be restored to the original size. In other word, the first flexible portion 75*a* and the second flexible portion 75*b* are restored to the natural state. By doing so, the first protrusion 78*a*, the first fixing portion 76*a* and the first base 74*a* would clamp the first electrode end from atop and underneath 12*a*, the second protrusion 78*b*, the second fixing portion 76*b* and the second base 74*b* would clamp the second electrode end from atop and underneath 12*b*, and the first electrode end 12*a* and the second electrode end 12*b* would be electrically connected to the lamp clamping and electrically connecting device 73.

To the contrary, when the user would like to disassemble the lamp 12 from the case 11, the user only needs to reverse the above-disclosed lamp assembling procedure, the lamp 12 can be easily detached and disassembled from the lamp clamping and electrically connecting device 13.

However, anyone who has basic knowledge relevant to the scope of technology of the present embodiment will understand the scope of technology of the present embodiment is not to be limited thereto. For example, the lamp 12 is moved towards or away from the first base 74*a* and the second base 74*b* along the normal direction of the surface (z direction for instance) of the first base 74*a* or the second base 74*b*, the tube of the lamp 12 is perpendicular to the normal direction of the surface of the first base 74*a* or the second base 74*b*, and the tube of the lamp 12 extends along the x direction. Besides, the lamp clamping and electrically connecting device 73 contains metal. The structures of the first base 74*a*, the first flexible portion 75*a*, the first fixing portion 76*a* and the first protrusion 78*a* can be formed in one piece. The structure of the second base 74*b*, the second flexible portion 75*b*, the second fixing portion 76*b* and the second protrusion 78*b* can be integrally formed in one piece. Besides, the first flexible portion 75*a* and the second flexible portion 15*b* can be two metal elastic sheets, and the first protrusion 78*a* and the second protrusion 78*b* can be two metal protrusions. In the present embodiment, the insulation protective cover disclosed in the above embodiment can be disposed on the lamp clamping and electrically connecting device 73. The insulation protective cover detachably covers the lamp clamping and electrically connecting device 73. Alternatively, the insulation protective cover is rotatably disposed on the case 11 or the lamp clamping and electrically connecting device 73. Besides, the lamp clamping and electrically connecting device 73 of the present embodiment is applicable to the lamp assembling and disassembling method disclosed above.

According to the lamp clamping and electrically connecting device and the method of assembling lamp disclosed in above embodiments of the invention, the design of vertically and downwardly embedding the lamp into and upwardly removing the lamp from the lamp clamping and electrically connecting device enables the lamp to be electrically connected to the lamp clamping and electrically connecting device when the lamp 12 is embedded into the lamp clamping and electrically connecting device, transcending the restrain imposed in conventional design that the lamp is soldered onto the case together with the conducting wire. Consequently, the lamp can be replaced within a short period of time, dispensing the de-soldering and the soldering steps, which are very time-consuming. So, the invention not only greatly simplifies the procedure of assembling and disassembling the lamp, but also reduces the hours required for assembling and disassembling the lamp, which is indeed very economical.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lamp clamping and electrically connecting device, comprising:

a base;

a first flexible portion and a second flexible portion bendably disposed on the base and interspaced to define an aperture; and a first protrusion and a second protrusion disposed on the inner sides of the first flexible portion and the second flexible portion, respectively, wherein when the first flexible portion and the second flexible portion are in a natural state, the gap between the first protrusion and the second protrusion is smaller than the diameter of an electrode end of a lamp, and the first protrusion, the second protrusion and the base clamp the electrode end of the lamp from atop and underneath.

2. The device according to claim 1, wherein when the electrode end is moved towards the base in the gap between the first protrusion and the second protrusion from the aperture, the electrode end presses the first protrusion and the second protrusion, so that the first flexible portion and the second flexible portion swing outwardly;

wherein when the electrode end touches the base, the first flexible portion and the second flexible portion are restored to the natural state, so that the first protrusion, the second protrusion and the base clamp the electrode end, and that the electrode end is electrically connected to the lamp clamping and electrically connecting device.

3. The device according to claim 2, wherein when the electrode end is moved away in the gap between the first protrusion and the second protrusion from the base, the electrode end presses the first protrusion and the second protrusion, so that the first flexible portion and the second flexible portion swing outwardly;

wherein when the electrode end passes the gap between the first protrusion and the second protrusion to move away from the base, the first flexible portion and the second flexible portion are restored to the natural state, so that the lamp is detached from the lamp clamping and electrically connecting device.

4. The device according to claim 3, wherein the lamp is moved towards or away from the base along the normal direction of the surface of the base, and the tube of the lamp is perpendicular to the normal direction of the surface of the base.

5. The device according to claim 1, wherein the base, the first flexible portion, the second flexible portion, the first protrusion and the second protrusion are integrally formed in one piece.

6. The device according to claim 1, including metal.

7. The device according to claim 1, wherein the first flexible portion and the second flexible portion are two metal elastic sheets.

8. The device according to claim 1, wherein the first protrusion and the second protrusion are two metal protrusions.

9. The device according to claim 1, being disposed on a case of a backlight module.

10. The device according to claim 9, wherein the backlight module further comprises:

an insulation protective cover for receiving the lamp clamping and electrically connecting device.

11. The device according to claim 10, wherein the insulation protective cover is rotatably disposed on the case and adjacent to the lamp clamping and electrically connecting device.

12. A backlight module, comprising:

a case;

a lamp having a first electrode end and a second electrode end disposed on the case; and a lamp clamping and electrically connecting device, comprising:

a first base and a second base interspaced to be disposed on the case;

a first flexible portion and a second flexible portion bendably disposed on the first base, respectively, wherein the first flexible portion and the second flexible portion are interspaced to define a first aperture;

a third flexible portion and a fourth flexible portion bendably disposed on the second base, respectively, wherein the third flexible portion and the fourth flexible portion are interspaced to define a second aperture;

a first protrusion and a second protrusion disposed on the inner sides of the first flexible portion and the second flexible portion, respectively; and a third protrusion and a fourth protrusion disposed on the inner sides of the third flexible portion and the fourth flexible portion, respectively, wherein when the first flexible portion, the second flexible portion, the third flexible portion and the fourth flexible portion are in a natural state, the gap between the first protrusion and the second protrusion and the gap between the third protrusion and the fourth protrusion are smaller than the diameter of the first electrode end and that of the second electrode end, respectively, the first protrusion, the second protrusion and the first base clamp the first electrode end of the lamp from atop and underneath, and the third protrusion, the fourth protrusion and the second base clamp the second electrode end of the lamp from atop and underneath.

13. The device according to claim 12, wherein when the first electrode end is moved towards the first base in the gap between the first protrusion and the second protrusion from the first aperture and when the second electrode end is moved towards the second base in the gap between the third protrusion and the fourth protrusion from the second aperture, the first electrode end presses the first protrusion and the second protrusion and the second electrode end presses the third protrusion and the fourth protrusion, so that the first flexible portion, the second flexible portion, the third flexible portion and the fourth flexible portion swing outwardly;

wherein when the first electrode end passes through the first protrusion and the second protrusion and touches the first base and when the second electrode end passes through the third protrusion and the fourth protrusion and touches the second base, the first protrusion, the second protrusion, the third protrusion and the fourth protrusion are restored to the natural state, so that the first protrusion, the second protrusion and the first base clamp the first electrode end, and that the third protrusion, the fourth protrusion and the second base clamp the second electrode end, and that the first electrode end and the second electrode end are electrically connected to the lamp clamping and electrically connecting device.

14. The backlight module according to claim 13, wherein when the first electrode end is moved away from the first base in the gap between the first protrusion and the second protrusion and when the second electrode end is moved away from the second base in the gap between the third protrusion and the fourth protrusion, the first electrode end presses the first protrusion and the second protrusion, the second electrode end presses the third protrusion and the fourth protrusion, so that the first flexible portion, the second flexible portion, the third flexible portion and the fourth flexible portion swing outwardly;

wherein when the first electrode end passes through the first protrusion and the second protrusion to move away from the first base and when the second electrode end passes through the third protrusion and the fourth protrusion to move away from the second base, the first flexible portion, the second flexible portion, the third flexible portion and the fourth flexible portion are restored to the natural state, and the lamp is detached from the lamp clamping and electrically connecting device.

15. The backlight module according to claim 14, wherein the lamp is moved towards or away from the first base and the second base along the normal direction of the surface of the first base, and the tube of the lamp is perpendicular to the normal direction of the surface of the first base.

16. The backlight module according to claim 12, wherein the lamp clamping and electrically connecting device includes metal.

17. The backlight module according to claim 12, further comprising:

an insulation protective cover for receiving the lamp clamping and electrically connecting device.

18. The backlight module according to claim 17, wherein the insulation protective cover is rotatably disposed on the case and adjacent to the lamp clamping and electrically connecting device.

19. A lamp clamping and electrically connecting device, comprising:

a base;

a fixing portion disposed on the base;

a flexible portion bendably disposed on the base and interspaced with the fixing portion to define an aperture; and a protrusion disposed on the inner side of the flexible portion, wherein when the flexible portion is in a natural state, the gap between the protrusion and the fixing portion is smaller than the diameter of an electrode end of a lamp, and the protrusion, the fixing portion and the base clamp the electrode end of the lamp.

20. The device according to claim 19, wherein when the electrode end is moved towards the base in the gap between the protrusion and the fixing portion from the aperture, the electrode end presses the protrusion, so that the flexible portion swings outwardly;

wherein when the electrode end touches the base, the flexible portion are restored to the natural state, so that the protrusion, the fixing portion and the base clamp the electrode end, and that the electrode end is electrically connected to the lamp clamping and electrically connecting device.

21. The device according to claim 20, wherein the lamp is moved towards or away from the base along the normal direction of the surface of the base, and the tube of the lamp is perpendicular to the normal direction of the surface of the base.

22. The device according to claim 19, wherein the base, the flexible portion, the fixing portion and the protrusion are integrally formed in one piece.

23. The device according to claim 19, including metal.

24. The device according to claim 1, wherein at least one of the base, the first flexible portion, the second flexible portion, the first protrusion and the second protrusion contacts the electrode end of the lamp to be electrically connected to the electrode end.

25. The backlight module according to claim 12, wherein at least one of the first base, the first flexible portion, the second flexible portion, the first protrusion and the second protrusion contacts the first electrode end of the lamp to be electrically connected to the first electrode end, and at least one of the second base, the third flexible portion, the fourth flexible portion, the third protrusion and the fourth protrusion contacts the second electrode end of the lamp to be electrically connected to the second electrode end.

26. The device according to claim 19, wherein at least one of the base, the fixing portion, the flexible portion and the protrusion contacts the electrode end of the lamp to be electrically connected to the electrode end.

* * * * *